United States Patent [19]

Rigden

[11] 4,232,243

[45] Nov. 4, 1980

[54] HIGH PRESSURE ELECTRIC DISCHARGE LAMP

[75] Inventor: Sydney A. R. Rigden, Hemel Hempstead, England

[73] Assignee: The General Electric Company Limited, London, England

[21] Appl. No.: 33,437

[22] Filed: Apr. 26, 1979

Related U.S. Application Data

[63] Continuation-in-part of Ser. No. 839,654, Oct. 5, 1977, abandoned.

[30] Foreign Application Priority Data

Oct. 19, 1976 [GB] United Kingdom ..... 43310/76
Dec. 20, 1976 [GB] United Kingdom ..... 53088/76

[51] Int. Cl.[2] ..... H01J 61/073; H01J 61/09; H01J 61/18

[52] U.S. Cl. ..... 313/217; 313/218; 313/229; 313/346 R

[58] Field of Search ..... 313/218, 217, 225, 229, 313/346 R

[56] References Cited

U.S. PATENT DOCUMENTS

| | | | |
|---|---|---|---|
| 3,029,359 | 4/1962 | White | 313/217 X |
| 3,363,134 | 1/1968 | Johnson | 313/225 X |
| 3,405,303 | 10/1968 | Koury et al. | 313/218 X |
| 3,445,719 | 5/1969 | Thouret et al. | 313/229 X |
| 3,530,327 | 9/1970 | Zollweg et al. | 313/229 X |
| 3,911,308 | 10/1975 | Akutsu et al. | 313/229 X |
| 4,001,623 | 1/1977 | Howles et al. | 313/229 X |
| 4,056,751 | 11/1977 | Gungle et al. | 313/229 X |

FOREIGN PATENT DOCUMENTS

| | | |
|---|---|---|
| 1193057 | 5/1970 | United Kingdom . |
| 1462955 | 1/1977 | United Kingdom . |
| 1476914 | 6/1977 | United Kingdom . |

*Primary Examiner*—Palmer C. Demeo
*Attorney, Agent, or Firm*—Kirschstein, Kirschstein, Ottinger & Cobrin

[57] ABSTRACT

In a high pressure electric discharge lamp having tungsten electrodes and a discharge envelope filling of mercury, rare gas, and metal halides, activator material consisting essentially of scandium oxide is incorporated in the electrodes, in the form of a solidified melt substantially filling a cavity in the electrode and adherent to the electrode structure, and the halides of the filling consist of iodide(s) and bromide(s), including scandium iodide and/or scandium bromide, in relative proportions such that the atomic ratio of total bromine to total iodine is 20:80 to 60:40. The electrodes are preferably tungsten wire coils, the scandium oxide filling the interior of the coil and penetrating into the interstices between the coil turns. The filling preferably includes sodium iodide and/or sodium bromide, and may include additional iodides and/or bromides. The combination of the scandium oxide activator and the bromide/iodide filling gives high luminous efficacy and good lumen maintenance.

10 Claims, 1 Drawing Figure

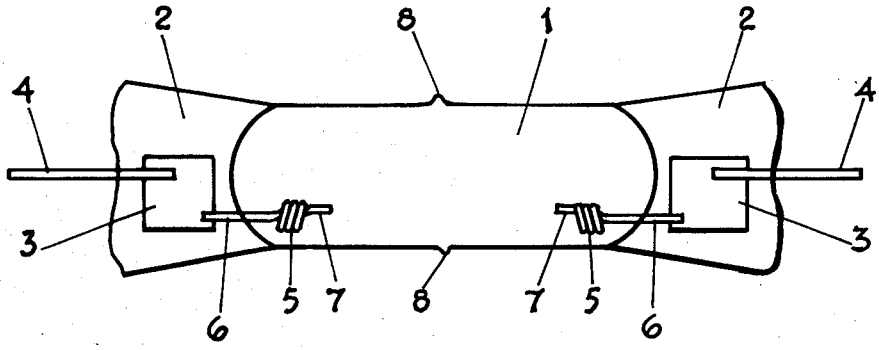
2
8
1
2
4
4
3
3
6
5
7
8
7
5
6

HIGH PRESSURE ELECTRIC DISCHARGE LAMP

This is a continuation-in-part of application Ser. No. 839,654 filed Oct. 5, 1977, and now abandoned.

This invention relates to high pressure electric discharge lamps of the type (hereinafter referred to as the type specified) including a discharge envelope containing a filling consisting of mercury, rare gas, and at least two metal halides which are vaporisable at the operating temperature of the lamp, and having mounted within it a pair of tungsten electrodes between which an electric discharge passes, through the filling gas and vapour, in operation of the lamp, each electrode being attached to an electrically conducting lead extending to the exterior of the discharge envelope and connected to a terminal, carried by an outer envelope of light-transmissive vitreous material in which the discharge envelope is enclosed, for connection of the electrode to a source of electric current supply for operation of the lamp. The term "high pressure," as used herein, is to be understood to mean that the total vapour pressure developed within the discharge envelope in normal operation of the lamp is at least one atmosphere.

The electrodes of known lamps of this type may or may not be activated with a suitable electron emissive material. Unactivated tungsten electrodes give high luminous efficacy in operation of the lamp, but the incorporation of an activator in the electrodes is desirable for obtaining good lumen maintenance. However, some materials which have been proposed for use as activators produce undesirable effects, arising from reaction of the activator material with metal halides in the lamp filling, for example an increase in the lamp voltage and/or reduction in efficacy.

It is also well known to include various combinations of metal iodides in the fillings of lamps of the said type, in order to produce lamps having high luminous efficacy and desired colour appearance and colour rendering properties, one particularly advantageous combination of such compounds consisting of sodium iodide and scandium tri-iodide. However it has been found that the lumen maintenance of such lamps is variable, the luminous efficacy being reduced, after varying periods of operation, as a result of blackening of the discharge envelope wall, which appears to be due to deposition of tungsten evaporated from the electrodes: this effect is particularly marked when scandium iodide is present.

It is an object of the present invention to provide, in lamps of the type specified which include a scandium halide in the filling, an improved combination of electrode activator material and filling composition whereby the above-mentioned undesirable effects can be reduced or eliminated, and improved lumen maintenance in operation of the lamps can be obtained.

According to the invention, in a high pressure electric discharge lamp of the type specified, an improvement is provided which consists of, in combination, the incorporation within a cavity in the structure of each electrode, of a quantity of activator material consisting essentially of scandium oxide, possibly with trace impurities, the said activator material being in the form of a solidified melt substantially filling the said cavity and adherent to the electrode structure, and the provision in the discharge envelope of a filling as aforesaid in which the metal halides consist of at least one metal iodide and at least one metal bromide, including scandium iodide and/or scandium bromide, in relative proportions such that the percentage atomic ratio of the total amount of bromine to the total amount of iodine in said metal halides is in the range of 20:80 to 60:40.

Preferably the activator material consists wholly of scandium oxide in a state of high purity. However, scandium oxide as commercially available usually contains trace impurities such as silica, rare earths, and various metal oxides: the total proportion of such impurities usually does not exceed 1% by weight of the scandium oxide, and preferably, for the purpose of the present invention, is considerably lower than this.

I have found that the use of scandium oxide, in the form of a solidified melt adherent to the electrode structure, as the activator in lamps of the type with which the invention is concerned, especially those in which a scandium halide is included in the discharge envelope filling, is advantageous since it facilitates rapid starting of the discharge, and gives high luminous efficacy equal to that obtained with unactivated tungsten electrodes, and good lumen maintenance. In order to achieve successful activation of the electrodes, it is essential that the scandium oxide is incorporated into the electrode structure by melting so that, on cooling, it will form a solid glassy core substantially filling the electrode cavity and adhering to the electrode structure, thus ensuring that little or no dissipation of the scandium oxide, by sputtering or evaporation, will occur during operation of the lamp. Preferably each electrode consists essentially of a coil of tungsten wire, the activator material substantially filling the interior of the coil and adhering to the coil as a result of at least partial penetration of the melt into the interstices between the turns of the coil. In the preferred method of manufacturing an electrode, the activator material is introduced into a cavity in the electrode, in particular into the interior of a coil, in the form of an aqueous slurry of scandium oxide powder, the electrode subsequently being heated to a sufficiently high temperature to cause the scandium oxide to melt and adhere to the electrode structure.

It will be understood that the constituents of the discharge envelope filling specified above are those which are initially introduced into the discharge envelope during the manufacture of the lamp; thus the metal halides present are of stoichiometric composition, the initial filling including no free metal (apart from mercury) and no excess halogen, although metal and/or halogen atoms or ions will be liberated subsequently as a result of reactions and/or dissociation occurring during operation of the lamp. The metal halide constituents of the filling preferably include the iodide and/or bromide of sodium in addition to the iodide and/or bromide of scandium. Thus some preferred discharge envelope fillings for the lamps of the invention consist of mercury and rare gas together with sodium bromide and scandium iodide, or with sodium iodide and scandium bromide, or with sodium iodide and scandium iodide and sodium bromide, or with sodium iodide and scandium iodide and scandium bromide, in each case with or without one or more additional metal iodides and/or bromides, for example thallium iodide, indium iodide, or caesium iodide.

I have found that the presence of one or more metal bromides, in admixture with one or more metal iodides, with a total bromine to total iodine ratio in the range specified above, reduces or prevents blackening of the discharge envelope wall in operation of the lamp. The combination of the use of a scandium oxide activator in the form specified, with the inclusion of a metal bromide or bromides as well as an iodide or iodides in the filling, is particularly beneficial in giving high luminous efficacy and good lumen maintenance, the latter resulting in increased useful operational life of the lamp. The reduction or prevention of blackening of the discharge envelope wall may be due to the promotion of a tungsten-halogen regenerative reaction cycle whereby tungsten evaporated from the electrodes is redeposited thereon, which cycle does not take place in a lamp of the type specified in which metal iodides are the only halides present in the filling. In addition, it appears that the bromine of the metal bromide or bromides in the filling acts as a getter for any hydrogen present in the envelope, thus preventing blackening due to the well known water-tungsten cycle which can arise from the use of an oxide activator, and also leaving iodine, released by dissociation of the metal iodide or iodides, free to react with the scandium oxide activator to replenish or provide scandium iodide in the filling. The scandium oxide thus performs a dual role, being enabled by the presence of the bromine to contribute to the filling, as well as functioning as an electrode activator.

The discharge envelope will usually be of tubular form, the electrodes being supported by the end closures of the envelope and extending respectively into the two end regions of the envelope. Thus a coil electrode is supported by an integral linear portion of wire which is sealed into the end closure of the discharge envelope so that the coil extends longitudinally into the envelope; preferably the coil also has an integral linear portion of wire extending from its inner end towards the centre of the discharge envelope, for facilitating starting and stabilisation of the discharge. If desired, each said coil may be surrounded by an outer coil of tungsten wire preferably extending beyond the free end of the inner coil: such an outer coil assists in preventing sputtering of the scandium oxide from within the electrode into the envelope, and reduces the operating temperature of the electrode.

The tubular discharge envelope is suitably formed of fused silica and may be closed at both ends by pinch seals of conventional form, in which a strip of molybdenum foil is embedded in the pinch, the electrode and a lead wire extending to the exterior of the pinch being attached respectively to the inner and outer ends of the foil, for example by welding. In a lamp in accordance with the invention which is so designed, and which has a filling of such composition and pressure, that the discharge produced in operation is of the wall stabilised form, the electrodes are sealed into the centres of the respective pinches so as to extend substantially along the longitudinal axis of the discharge envelope. However, in a lamp which is designed to be operated in such a position that the longitudinal axis of the discharge envelope is disposed horizontally, and in which the dimensions of the discharge envelope and the filling composition and pressure are such that the discharge produced in operation is in the form of a constricted arc, the electrodes are preferably sealed into the respective pinches at locations offset from the centres of the pinches, so that the electrodes extend into the envelope with their longitudinal axes substantially parallel to the longitudinal axis of the envelope, the lamp being mounted, for operation, with orientation such that the electrodes lie substantially vertically below the discharge envelope axis. For such offcentre mounting of the electrodes in the discharge envelope, the molybdenum foils may also be offset from the centres of the pinches; preferably, to give a more robust construction of the seals, the molybdenum foils are of greater width than those usually employed in seals of this type, each foil being located so that the edge thereof which is uppermost, when the lamp is correctly orientated for operation, lies on or above the longitudinal axis of the pinch, and the electrode and lead wire being attached respectively near the lower edge and near the upper edge thereof.

The location of the electrodes below the discharge envelope axis, in a lamp operated horizontally, is advantageous in that, with this arrangement, the upward bowing of the constricted arc in operation does not cause the arc to approach as closely to the upper part of the discharge envelope wall as it does when the electrodes are coaxial with the envelope, as in a conventional lamp of the type specified, so that overheating of the upper part of the envelope wall is avoided or reduced. At the same time the lower part of the envelope wall is raised to a higher temperature than in a conventional lamp as aforesaid, so that the temperature difference between the upper and lower portions of the envelope wall is reduced: reduction of this temperature difference is desirable, to enable a relatively high vapour pressure to be maintained in the envelope, with resulting high luminous efficacy of the lamp, and also to prevent condensation of metal halides of the filling on the central region of the lower part of the envelope wall. In the case of a lamp containing a sodium halide as a constituent of the filling, an additional advantage arises from the location of the electrodes, and hence of the discharge in operation, nearer to the lower part of the discharge envelope wall: thus the volume of the region of the envelope which is predominantly occupied by thermally excited sodium ions during operation of the lamp, namely the region between the discharge and the upper part of the envelope wall, is increased, and this again results in an increase in the luminous efficacy of the lamp. Furthermore, it is possible to employ a higher filling pressure than is usual in lamps of the type specified, without increasing the risk of the upper part of the discharge envelope wall becoming overheated, and in addition it is possible to employ a discharge envelope of internal diameter somewhat larger than is suitable for a lamp of similar power dissipation but having axially disposed electrodes, since the disposition of the electrodes below the envelope axis prevents any significant reduction in the operating temperature of the lower part of the envelope wall. An increased discharge envelope diameter is advantageous in that it permits the lamp to be run at a higher loading without risk of overheating of the envelope wall, and also, when a sodium halide is present, in providing an increased volume of the envelope for occupation by thermally excited sodium ions in operation.

The outer envelope of a lamp in accordance with the invention is preferably of the double ended type, in which the lead from each electrode is sealed through the end of the outer envelope adjacent to that electrode, and each end of the outer envelope is fitted with a cap incorporating a terminal to which the lead sealed through that end is attached. Furthermore, the outer envelope suitably is of tubular form and is fitted with a pair of bipin caps of the type generally employed for tubular low pressure fluorescent discharge lamps, one pin on each cap constituting a said terminal. If desired, the interior surface of the outer envelope wall may be wholly or partially coated with an infra-red reflecting light-transmissive film, for example of tin oxide or indium oxide, to raise the overall temperature attained by the discharge envelope in operation of the lamp, and to assist in reducing differences in operating temperature between different parts of the discharge envelope. The outer envelope may also contain a suitable gas filling if desired.

A specific form of lamp incorporating the improvement in accordance with the invention, and a method of manufacturing the lamp, will now be described by way of example, with reference to the accompanying diagrammatic drawing, which shows the discharge envelope of the lamp in elevation.

The lamp of the example is designed for operation with the longitudinal axis of the discharge envelope disposed horizontally. The discharge envelope consists of a fused silica tube 1, containing a filling of mercury, rare gas, one or more metal iodides, and one or more metal bromides, including scandium iodide and/or scandium bromide, and closed at each end by a pinch 2, into which is sealed an assembly consisting of a wide molybdenum foil strip 3, a molybdenum lead wire 4, and an electrode located between the envelope axis and the envelope wall. Each electrode consists of a single coil 5 of tungsten wire with a linear extension of the wire at each end of the coil, the extension 6 at the outer end of the coil being attached to the inner end of the molybdenum foil, and the extension 7 at the inner end of the coil extending into the envelope substantially parallel to the envelope axis; the interiors of the electrode coils are filled with activator material consisting of a solidified melt of scandium oxide. The construction of the lamp is completed by mounting the discharge envelope in known manner within a tubular outer envelope of borosilicate glass fitted with a bipin cap at each end, each of the lead wires 4 being connected to one of the pins which constitute the lamp terminals for connection to a source of electric current supply for operation of the lamp. (The outer envelope is of a well known form and is not shown in the drawing.)

For the manufacture of the lamp described above with reference to the drawing, each of the electrodes is first prepared by forming a thick paste of powdered scandium oxide, preferably of the highest purity grade available, in water, filling the interior of the coil with this paste, allowing the paste to dry, and then suspending the electrode in a tungsten cylinder surrounded by an eddy current heating coil, by means of which the electrode is heated, in a flowing atmosphere of argon, to a temperature of 3200° C. to cause the scandium oxide to melt and flow into the interstices of the coil. On cooling the electrode, the scandium oxide solidifies to form a solid mass adhering to the coil.

The electrode extensions 6 and lead wires 4 are then welded to the respective molybdenum foils in the positions shown in the drawing, and the discharge envelope is formed in conventional manner by pinching the ends of a suitable length of fused silica tubing over the foil-electrode-lead assemblies. The envelope is then baked in the conventional manner at a temperature of 1000° C. for 7.5 hours in vacuum, and the desired filling is introduced into the discharge envelope via side tubes, which are then sealed off to leave the pips 8: it is necessary to ensure that no moisture or elemental iodine is introduced into the discharge envelope during or subsequently to the baking of the envelope or during the introduction of the filling. Finally the discharge envelope is mounted in the outer envelope and the latter is sealed and capped, in known manner.

For operation, the lamp is mounted in a pair of lampholders and is disposed horizontally and so orientated that the inner extensions 7 of the electrodes lie substantially vertically below the longitudinal axis of the discharge envelope.

Some specific lamps of the form shown in the drawing will now be described in the following examples.

EXAMPLE 1

The discharge envelope 1 has an internal diameter of 12 mm and an internal length of 30 mm, the molybdenum foils 3 are 5 mm wide, and the extensions 7 of the electrodes are positioned 3 to 4 mm from the interior surface of the adjacent part of the discharge envelope wall, and thus 2 to 3 mm below the envelope axis when the lamp is in the correct horizontal operating position. In each electrode, the coil 5 consists of three turns of 0.5 mm diameter tungsten wire, the internal diameter of the coil being 0.6 mm, and the inner extension 7 is 2 mm long; the horizontal length of the discharge path between the tips of the said extensions is 21 mm. The discharge envelope filling consists of 21 mg of mercury, 20 mg of sodium iodide, 10 mg of scandium tri-iodide, 7 mg of sodium bromide, and argon at a room temperature pressure of 35 torr. In normal operation this lamp dissipates 175 watts at a tube voltage of 120 volts, has an initial luminous efficacy of over 100 lumens per watt, with a colour temperature of 3500° to 4000° K., and shows 92% lumen maintenance after 1000 hours operation. By comparison, a lamp which is identical in all respects with the exception that the sodium bromide is omitted from the filling shows a lumen maintenance of 80% after 1000 hours operation.

EXAMPLE 2

The lamp of this example has a discharge envelope of the same dimensions, and electrodes of the same dimensions and positions, as those described in Example 1, and has a discharge envelope filling consisting of 21 mg of mercury, 10 mg of sodium iodide, 10 mg of scandium tri-iodide, 7 mg of sodium bromide, and argon at a room temperature pressure of 35 torr. This lamp, in normal operation, dissipates 175 watts at a tube voltage of 120 volts, has an initial luminous efficacy of over 100 lumens per watt with a colour temperature of 4000° to 4500° K. and shows 85% lumen maintenance after 1000 hours operation. By comparison, a lamp which is identical apart from the omission of sodium bromide from the filling shows a lumen maintenance of 70% after 1000 hours operation.

EXAMPLE 3

In the lamp of this example, the discharge envelope dimensions and the electrode dimensions and positioning are as described in Example 1, and the discharge envelope filling consists of 21 mg of mercury, 21 mg of sodium iodide, 5 mg of scandium tri-iodide, 3 mg of thallium iodide, 0.6 mg of indium iodide, 9 mg of sodium bromide, and argon at a room temperature pressure of 35 torr. In normal operation this lamp dissipates 175 watts at a tube voltage of 120 volts, has an initial luminous efficacy of over 90 lumens per watt with a colour temperature of 4000° to 4500° K., and shows 90% lumen maintenance after 1000 hours operation. By comparison, a lamp of the same dimensions and operating characteristics, and with the same filling except that sodium bromide is omitted, shows lumen maintenance of 80% after 1000 hours operation.

I claim:

1. In a high pressure electric discharge lamp including a discharge envelope which contains a filling consisting of mercury, rare gas, and at least two metal halides which are vaporizable at the operating temperature of the lamp, and which has mounted within it a pair of tungsten electrodes between which an electric discharge passes through the filling in operation of the lamp, each said electrode being attached to an electrically conducting lead extending to the exterior of the discharge envelope and connected to a terminal carried by an outer envelope of light-transmissive vitreous material in which the discharge envelope is enclosed, the improvement consisting of, in combination, the incorporation within a cavity in the structure of each said electrode of a quantity of activator material consisting essentially of scandium oxide, the said activator material being in the form of a solidified melt substantially filling the said cavity and adherent to the electrode structure, and the provision in the discharge envelope of said filling in which the metal halides consist of at least one metal iodide and at least one metal bromide, including at least one member of the group consisting of scandium iodide and scandium bromide, in relative proportions such that the percentage atomic ratio of the total amount of bromine to the total amount of iodine in said metal halides is in the range of 20:80 to 60:40.

2. The improvement according to claim 1, wherein the said activator material consists wholly of scandium oxide in a state of high purity.

3. The improvement according to claim 1, for a lamp wherein the discharge envelope is a tube of fused silica closed at both ends by pinch seals into which the electrodes are sealed so as to extend into the respective end regions of the discharge envelope, in which each said electrode consists essentially of a coil of tungsten wire having interstices between the turns of the coil, and in which the solidified melt constituted by the said activator material substantially fills the interior of each said coil, adheres to the coil turns, and penetrates at least partially into the said interstices.

4. The improvement according to claim 1, wherein the said filling of the discharge envelope includes at least one member of the group consisting of sodium iodide and sodium bromide.

5. The improvement according to claim 4, wherein the said filling of the discharge envelope also includes at least one member of the group consisting of thallium iodide, indium iodide, and caesium iodide.

6. The improvement according to claim 3, for a lamp which is designed to be operated with the longitudinal axis of the discharge envelope disposed horizontally, and wherein each said electrode includes a linear portion of wire extending from the inner end of said coil towards the centre of the discharge envelope and the electrodes are disposed off-centre with respect to said axis so that when the lamp is mounted in the operating position the tips of said linear extensions from the inner ends of the electrode coils lie below the said axis, in which the filling of the discharge envelope consists of mercury, sodium iodide, scandium iodide, sodium bromide, and argon.

7. The improvement according to claim 6, for a lamp having a discharge envelope of internal diameter 12 mm and internal length 30 mm, and dissipating 175 watts in operation, wherein the said filling consists of 21 mg of mercury, 20 mg of sodium iodide, 10 mg of scandium iodide, 7 mg of sodium bromide, and argon at a pressure of 35 torr at room temperature.

8. The improvement according to claim 6, for a lamp having a discharge envelope of internal diameter 12 mm and internal length 30 mm, and dissipating 175 watts in operation, wherein the said filling consists of 21 mg of mercury, 10 mg of sodium iodide, 10 mg of scandium iodide, 7 mg of sodium bromide, and argon at a pressure of 35 torr at room temperature.

9. The improvement according to claim 3, for a lamp which is designed to be operated with the longitudinal axis of the discharge envelope disposed horizontally, and wherein each said electrode includes a linear portion of wire extending from the inner end of said coil towards the centre of the discharge envelope and the electrodes are disposed off-centre with respect to said axis so that when the lamp is mounted in the operating position the tips of said linear extensions from the inner ends of the electrode coils lie below the said axis, in which the filling of the discharge envelope consists of mercury, sodium iodide, scandium iodide, thallium iodide, indium iodide, sodium bromide, and argon.

10. The improvement according to claim 9, for a lamp having a discharge envelope of internal diameter 12 mm and internal length 30 mm, and dissipating 175 watts in operation, wherein the said filling consists of 21 mg of mercury, 21 mg of sodium iodide, 5 mg of scandium iodide, 3 mg of thallium iodide, 0.6 mg of indium iodide, 9 mg of sodium bromide, and argon at a pressure of 35 torr at room temperature.

* * * * *